United States Patent [19]

Roberts

[11] Patent Number: 4,516,919

[45] Date of Patent: May 14, 1985

[54] CAPACITY CONTROL OF ROTARY VANE APPARATUS

[75] Inventor: Richard W. Roberts, Lombard, Ill.

[73] Assignee: Borg-Warner Corporation, Chicago, Ill.

[21] Appl. No.: 509,834

[22] Filed: Jun. 30, 1983

[51] Int. Cl.[3] ..... F04C 18/00; F04C 29/10

[52] U.S. Cl. ..... 418/23; 418/24; 418/27

[58] Field of Search ..... 418/23, 24, 27

[56] References Cited

U.S. PATENT DOCUMENTS

| | | | |
|---|---|---|---|
| 1,603,437 | 10/1926 | Wingquist . | |
| 2,175,413 | 10/1939 | Sharar | 192/58 |
| 2,696,790 | 12/1954 | Crow | 103/120 |
| 3,137,235 | 6/1964 | Brown | 103/4 |
| 3,153,384 | 10/1964 | Castel et al. | 103/120 |
| 3,180,271 | 4/1965 | Hartmann | 103/120 |
| 3,828,569 | 8/1974 | Weisgerber | 418/23 |
| 3,904,327 | 9/1975 | Edwards et al. | 418/8 |
| 4,050,263 | 9/1977 | Adalbert et al. | 62/243 |
| 4,132,512 | 1/1979 | Roberts | 418/23 |

*Primary Examiner*—John J. Vrablik

*Attorney, Agent, or Firm*—Florian S. Gregorczyk

[57] ABSTRACT

A capacity control arrangement for a rotary vane fluid displacement apparatus, such as a rotary vane compressor, having a vane retaining means that normally engages and retains the vanes in their retracted or non-working position within the rotor defined guide slits of such rotary vane compressor. The retaining means are actuated to the vane-disengaged position by hydraulic control fluid which is communicated to the retaining means in response to an external parameter sensed by a control means.

12 Claims, 17 Drawing Figures

Fig. 7.
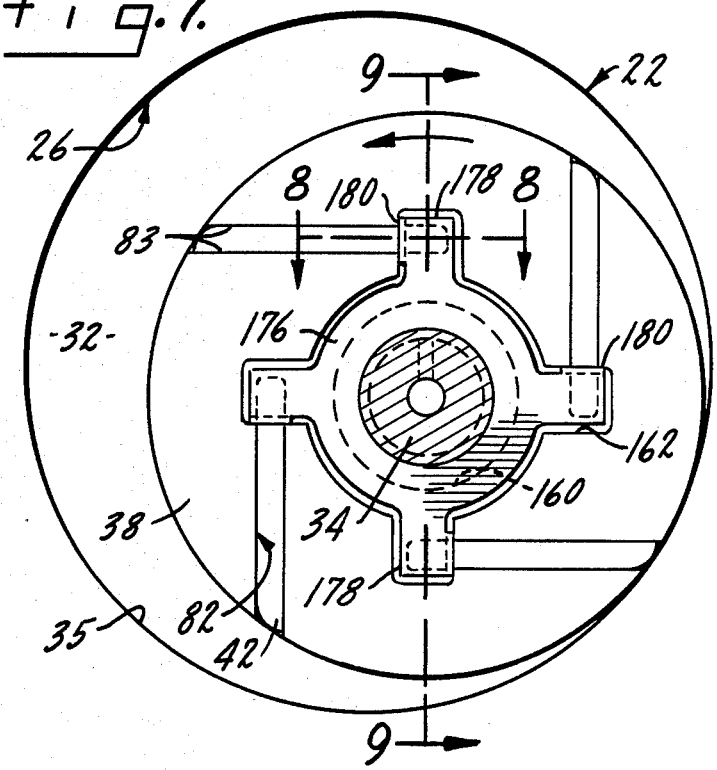
Fig. 8.
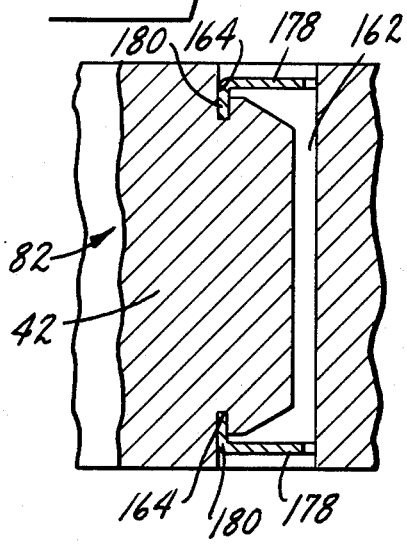
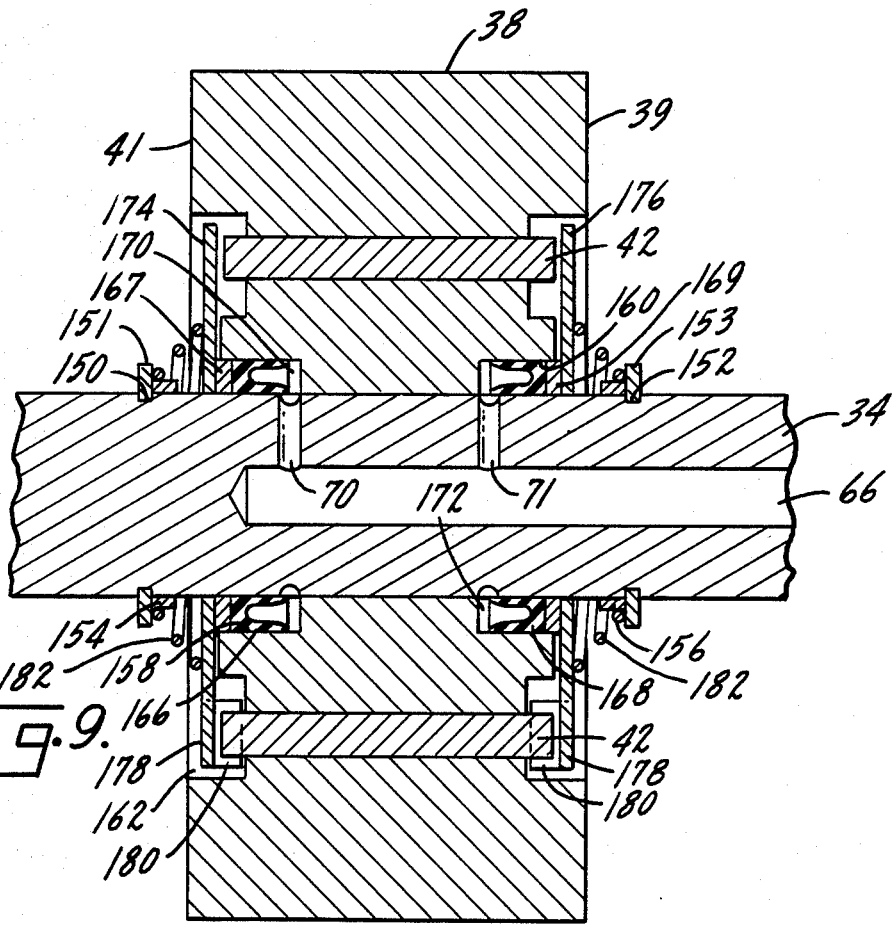
Fig. 9.

Fig.13.
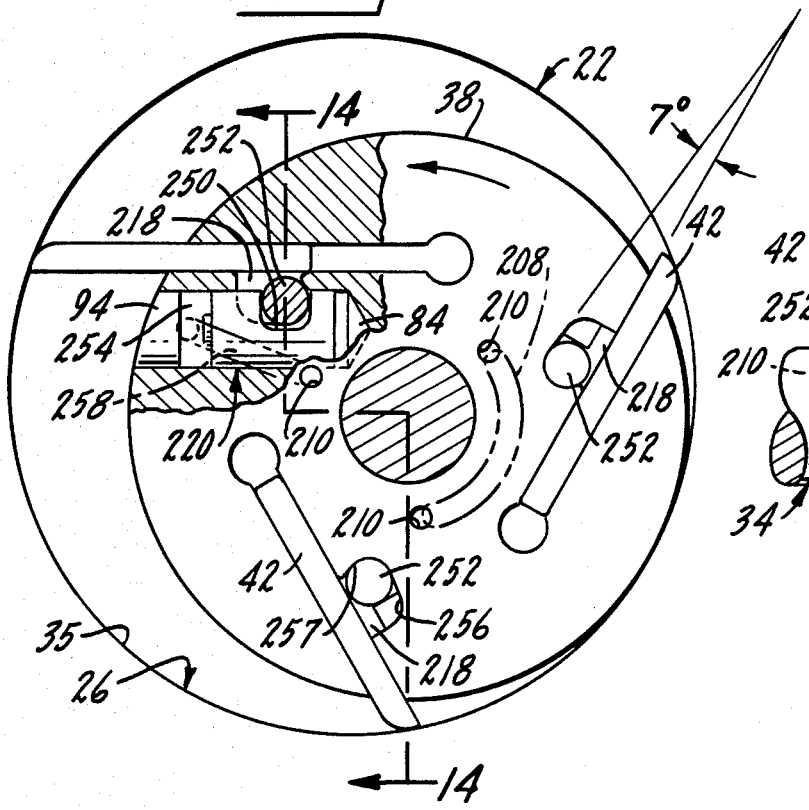
Fig.14.
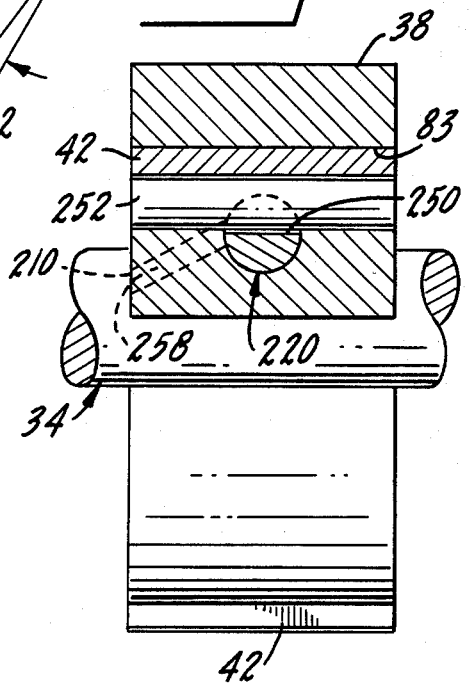
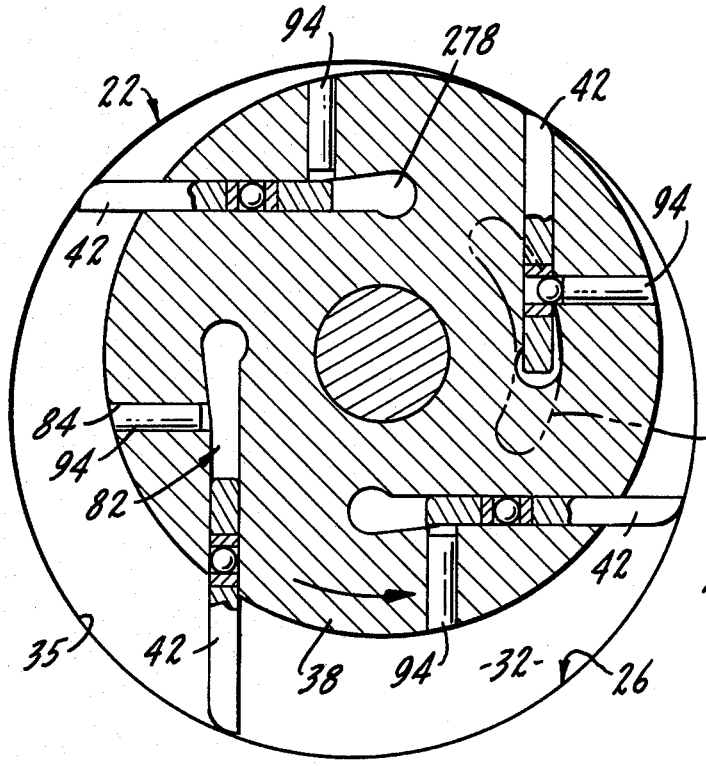
Fig.15.
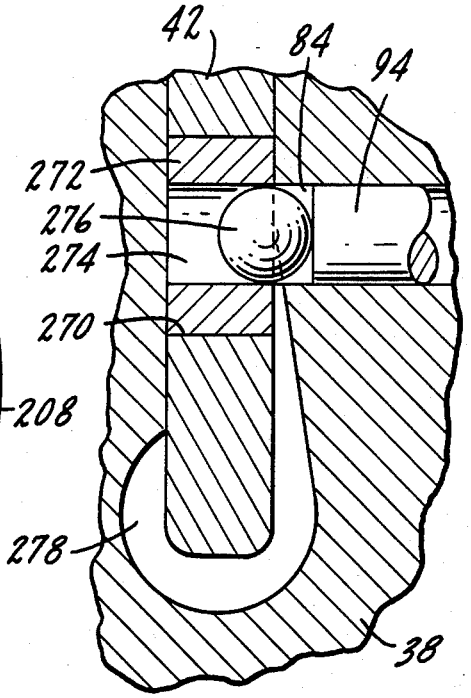
Fig.16.

CAPACITY CONTROL OF ROTARY VANE APPARATUS

BACKGROUND OF THE INVENTION

1. Field

The invention relates generally to the control of a fluid displacement apparatus, by controlling the volume of fluid displaced or transmitted through such apparatus in response to an external parameter. More specifically, this invention relates to a rotary vane compressor frequently utilized for passenger compartment air conditioning on automobiles. In such compressors, retention of the vanes in their retracted position stops the pumping action. The present invention discloses a means and control circuit for vane retention in the retracted position to modulate the compressor output in response to changing engine speeds, and cooling loads. It may replace the present clutch mechanism on an automotive air conditioning compressor for complete disengagement of the compressor from the driving means.

2. Prior Art

Control of the output or discharge from a compressor or rotary vane fluid displacement apparatus by control of the vanes has been demonstrated in the art. Methods usually employed to retain or retract these vanes utilize a mechanical clamping device, electromechanical device, control a clutch or use a regulator valve to control the discharge pressure. U.S. Pat. No. 2,696,790 (Crow) discloses a means to control radial movement of the blades from outside the pump utilizing an auxiliary source of hydraulic fluid and a manually operable cam mechanism. Cam mechanism rotation causes longitudinal movement of ring 27 to thus rotate pinions 30. Rotation of pins 30 adjusts rack 60 to control the outward movement of blades B. U.S. Pat. No. 2,175,413 (Sharar) teaches an hydraulic clutch with a slide or rod that is attached to two vanes and which slide is retractable to control the travel of the vanes through a pivot mechanism. An adjustable capacity vane pump is disclosed in U.S. Pat. No. 1,603,437 (S. G. Wingquist). The vanes and vane abutments are radially adjustable and the pump assembly itself comprises two vane pumps. The vanes 14 are actuated by springs 19 and the abutment vanes 20 are radially adjustable by the axial movement of slides 26 along the rotor axis. A continuous spring band to produce an outwardly biasing force on the vanes is taught in U.S. Pat. No. 3,904,327 (Edwards et al.), however, it does not teach vane retention. U.S. Pat. No. 3,137,235 (F. B. Brown) discloses a variable volume rotary pump which varies the pump delivery by moving a ring which defines the peripheral wall of the rotor chamber. U.S. Pat. No. 3,153,384 (Castel et al.) provides a vane type pump in which the vanes are continually pressured radially at pump pressure, but the rotor chamber wall is shiftable to attain a no pumping capacity by moving pivot rings. In U.S. Pat. No. 3,180,271 (Hartmann) fluid pressure is utilized to hold the vanes extended and controls volume flow by movement of a port ring. This device utilizes both a governor 31 and a volume limit control 43. A means for retaining a pair of vanes in a compressor is illustrated in U.S. Pat. No. 4,050,263 (Adalbert et al.). In this disclosure a locking member engages a vane projection to retain the vanes in the retracted position. The locking member is axially movable along the rotor axis by an electromagnetic means. U.S. Pat. No. 4,132,512 (Roberts) teaches a means of vane retention utilizing a permanent magnet and a change of polarity therein to retain the vanes in the retracted position.

SUMMARY OF THE INVENTION

The invention encompasses fluid control means for a rotary vane fluid displacement apparatus to maintain the sliding vanes in a rotary vane apparatus in a normally-retracted position. Hydraulic fluid is provided to move a retaining means to release the sliding vanes from their retracted position. Hydraulic fluid is provided through a control unit from a source such as a gerotor pump and the control unit monitors an external parameter to be responsive to a measurable quantity.

An automobile air-conditioner rotary vane compressor is operable at clutch engagement, however, it is desirable to eliminate the use of such clutch from a fuel economy as well as an original cost aspect. The present invention provides a means to reduce the fluid flow through such a rotary vane compressor and to eliminate the requirement and use of a clutch. The retention of the vanes in their guide slits essentially eliminates or totally mutes fluid flow through such a compressor. In the embodiments of the present invention such a compressor would be operable in response to a measurable parameter such as evaporator pressure, engine speed or passenger compartment temperature.

In the compressor operating mode of the present invention the hydraulic fluid provides actuation to withdraw the retaining means to allow the vanes to again become radially extended, contact the pressure chamber wall and provide compression to a compressible fluid. At a predetermined engine speed, evaporator pressure or other measured operating parameter the control unit interrupts hydraulic control fluid communication to the retaining means to allow the retaining means to move into engagement with the vanes to maintain the vanes in the withdrawn or nonworking position in the guide slits. When the vanes are in this withdrawn position compressible fluid flow through such compressor is almost nil. Hydraulic fluid for retaining means disengagement is provided by the same source supplying lubricating fluid for the air conditioning system and requires minimal added power to actuate the retaining means.

BRIEF DESCRIPTION OF THE DRAWINGS

In the figures of the drawings like reference numerals identify like components and in the drawings:

FIG. 4(*a*) is a cross-sectional view of the rotor illustrating the retaining means shown in FIG. 4 in the working mode;

FIG. 7 is an end view of an alternative embodiment of a vane retaining means of a rotary vane assembly;

FIG. 8 is a cross-sectional view along line 8—8 of the alternative embodiment retaining means of FIG. 7;

FIG. 9 is a cross-sectional view of the vane retaining means of FIG. 7 along line 9—9 in the retracted or nonworking position;

FIG. 13 is an end view of a rotor assembly and retaining means of an alternative embodiment having an arcuate recess for communicating hydraulic control fluid;

FIG. 14 is a cross-sectional view along line 14—14 illustrating the lateral passage for hydraulic fluid flow to the retaining means shown in FIG. 13;

FIG. 15 is an end view in cross-section of an alternative embodiment of a vane retaining means and rotor assembly;

FIG. 16 illustrates in enlarged detail the retaining means of FIG. 15.

DETAILED DESCRIPTION OF THE INVENTION

Figure 1:
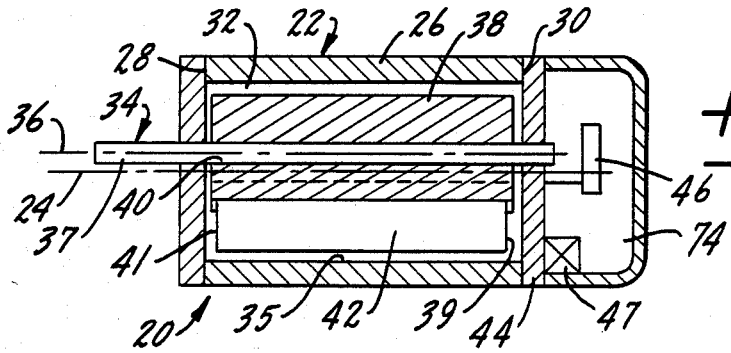
FIG. 1 is a block diagram illustrating the longitudinal parts relationship in a typical compressor structure.

Capacity control of a rotary vane fluid displacement apparatus 20 by use of a capacity control arrangement 21 to disengage a retaining means is illustrated in FIG. 1.

The broad relationship of various parts of a rotary vane fluid displacement apparatus 20, such as an automotive air conditioning compressor are illustrated in FIG. 1 in a longitudinal relationship. Rotary vane apparatus 20 includes a housing 22 generally of a cylindrical shape with a longitudinal or reference axis 24, a wall 26, first end 28, a second end 30, and an endplate 44 where wall 26 and ends 28 and endplate 44 mounted on second end 30 cooperate to define a compression chamber 32 with internal wall 35. A shaft 34 with longitudinal axis 36 and outer wall 37 extends through chamber 32 and second end 30 with its axis 36 parallel to but offset from housing axis 24. A rotor 38 defining a central throughbore 40 is mounted on shaft 34 in chamber 32. Rotor 38 includes a front face 39, a rear face 41, a plurality of longitudinal slots (not shown) and slidable vanes 42 operable in chamber 32. An endplate 44 is affixed to end 30 of housing 22 with shaft 34 extending therethrough, which endplate 44 provides control fluid communication from a source of fluid pressure shown as a pump 46, such as a lubricating gerotor pump, to the endplate 44. A control means 47 is provided to communicate the control fluid from the endplate 44 and to relieve the fluid pressure from pump 46.

Figure 2:
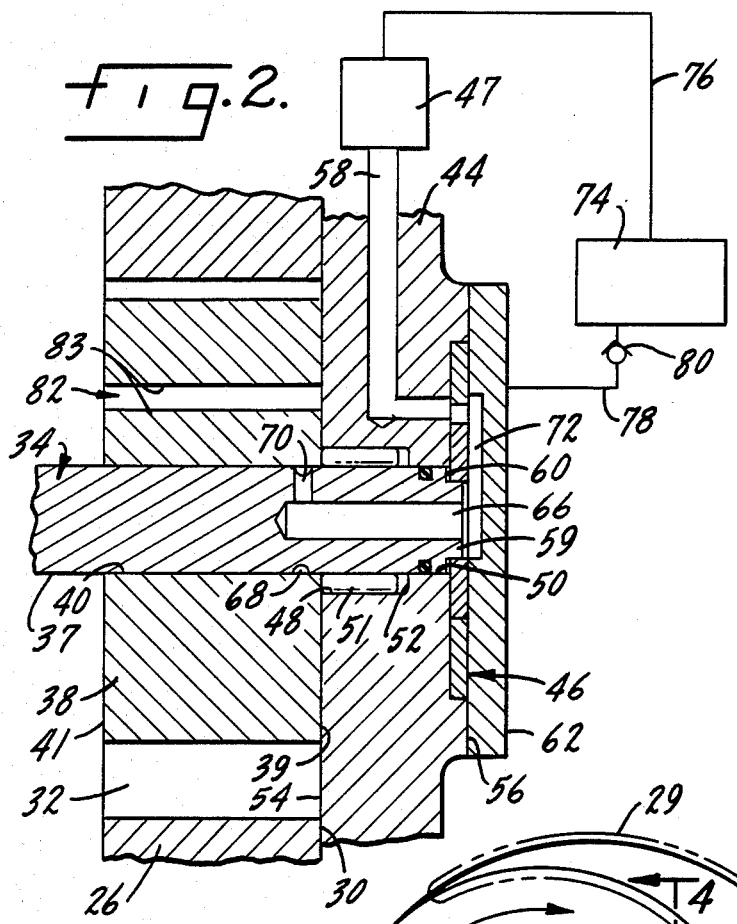
FIG. 2 illustrates in cross-section a preferred embodiment of a rotor and end plate assembly of a rotary vane apparatus as viewed from the left side of FIG. 2.

FIG. 2 is a detailed cross-section of rotor 38, second end 30, endplate 44, pump 46 and shaft 34 for use with a preferred embodiment of the invention. Endplate 44 defines a centrally located first bore 48, a second bore 50 of a smaller diameter than the first bore 48, a shoulder 52 at the junction of first bore 48 and second bore 50, a first face 54, a second face 56, and a central fluid passage 58. Shaft 34 extends through bore 40 of rotor 38, first bore 48 and second bore 50 and has a bearing means 51 mounted on shaft 34 to be retained in first bore 48 when endplate first face 54 seals second end 30 of housing 22. Shaft 34 defines a protuberance 59 extending approximately to endplate second face 56. Protuberance 59 has a smaller diameter than shaft 34 and defines a drive shaft shoulder 60 between these larger and smaller shaft diameters. Pump 46, shown as a gerotor type pump herein, is mounted within endplate 44 to engage protuberance 59 and includes pump endplate 62.

Drive shaft 34 defines an outer wall 37, a blind-hole bore 66, an annular groove 68 about its outer wall 64 and a cross-drilled passage 70 communicating between groove 68 and blind-hole bore 66. The means for selectively communicating hydraulic fluid through blind-hole bore 66 defines the annular groove 68 and in this embodiment such groove 68 is defined by shaft 34.

Pump endplate 62 defines a passage 72 and blind-hole bore 66 is open at protuberance 59 to communicate between cross-drilled passage 70 and passage 72 thereby providing fluid under pressure to blind-hole bore 66. Pump 46 further defines a conduit communicating to control fluid passage 58. Control means 47 may be a normally open control valve, such as a solenoid operated valve, to provide return flow from pump 46 to a sump 74 through a conduit 76 communicating between control means 47 and sump 74. Sump 74 communicates with pump 46 through a conduit means 78 having a check valve 80 through to inhibit back flow to sump 74 through conduit 78.

Figure 4:
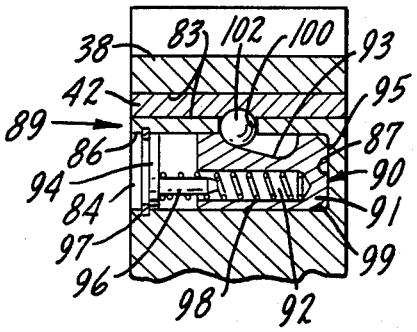
FIG. 4 is a cross-sectional view along line 4—4 of FIG. 3 illustrating the retaining means of the embodiment shown in FIG. 3 with the vanes in the inoperative mode.
Figure 4A:
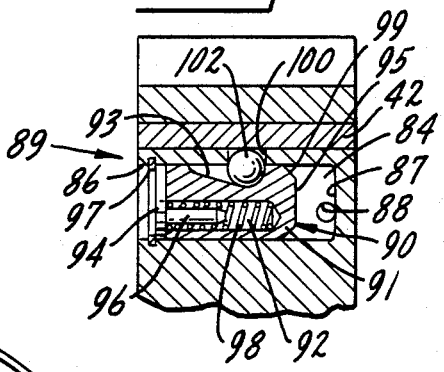
Figure 3:
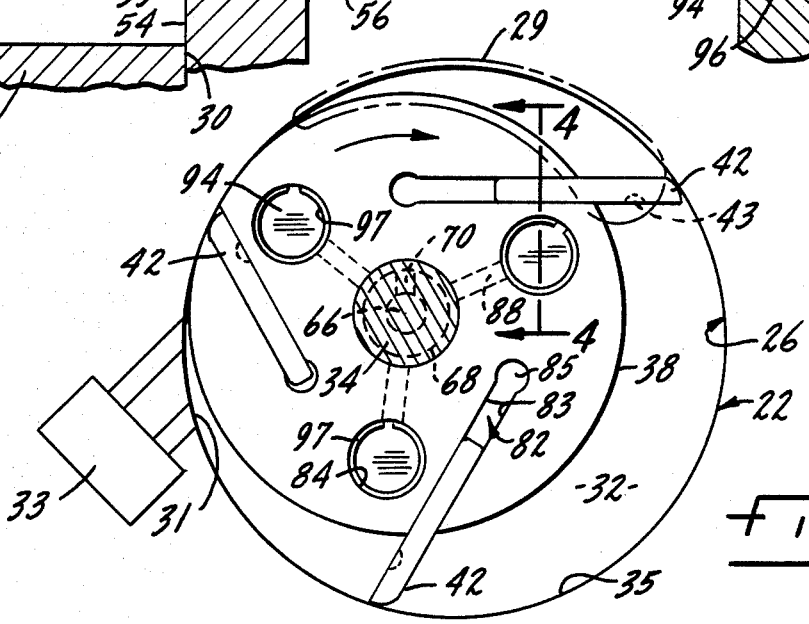
FIG. 3 is an end view of a rotor, housing and vane assembly with vane retaining means of a preferred embodiment.

Rotor 38 on shaft 34 in compression chamber 32 defines a plurality of longitudinal guide slits 82 with sidewalls 83 and root 85 as shown in FIG. 3. A plurality of slidable vanes 42, one in each of guide slits 82, are positioned to be reciprocable therein. Each vane 42 defines a detent 43. Associated with each vane is a vane retaining means 89. Rotor 38 defines a plurality of piston bores or lateral passages 84 with sidewall 86, and endwall 87 as well as a piston retention means 97, shown in FIGS. 3, 4 and 4(*a*). Rotor 38 defines a lateral passage 88 for each bore 84 which communicates between bore 84 and annular groove 68. A piston 90 with body 91, head 95 and chamber 99 is slidably operable in each bore 84. Each piston 90 defines a blind-hole bias spring bore 92 in body 91, and a ramp 93 on the periphery of body 91. Bore 84 is sealed by plug means 94 retained by a snap ring 97 which serves as a piston stop. Protruding from plug 94 is a cylindrical protuberance 96 about which a bias spring 98 is positioned and which spring 98 is matable with blind-hole bore 92 when piston 90 is in a working position (a working position being defined as a position as to allow vanes 42 to extend themselves to commence compression in a compressor assembly 20). Pistons 90 are operable between a working position and a nonworking position where vanes 42 are restrained in the retracted position within guide slits 82. This assembly of parts cooperate to define vane retaining means 89 in this embodiment.

Rotor 38 defines a ball passage 100 for each piston between guide slit 82 and bore 84. A hardened ball 102 is positioned at the intersection of piston bore 84 and is slidably operable on piston ramp 93 to be seated in bore 100 and detent 43 of vane 42 in the nonworking, retracted position illustrated in FIG. 4. In this nonworking position ball 102 moves up ramp 93 into slot 100 as piston 90 is moved by bias spring 98. When piston 90 is adjacent to endwall 87 ball 102 is at the top of ramp 93 and into slot 100 to contact vane 42 at its most retracted position and retains the vane 42 against vane sidewall 83. In the operative position of this embodiment hydraulic control fluid from pump 46 is communicated to bore 84 through blind-hole bore 66, cross-hole 70, annular groove 68 and lateral passsage 88 to force piston 90 to plug 94 against bias spring 98. In this position ball 102 moves along ramp 93 and out of contact with vane 42 and detent 43 to allow vane 42 to again freely move in guide slit 82 to contact wall 26 and commence the working or compression mode shown in FIG. 3.

Shown in FIG. 3 for purpose of explanation is an inlet port 29 defined by endplate 44 and a discharge port 31 having a discharge valve assembly 33. Inlet portion 29 provides access and communication to the compression chamber 32 for incoming refrigerant in an air conditioner, and discharge port 31 and valve assembly 33 provide egress for a compressed fluid. These elements are noted for purpose of illustration and are not limitations to the present invention.

This embodiment in FIG. 3 shows the fluid displacement apparatus 20 in the normal working mode. Slidable vanes 42 are extended from guide slits 82 to contact wall 26 and define segmented crescent-shaped cavities between vanes 42 in compression chamber 32. Pump 46 (in FIG. 2) draws fluid from sump 74 through conduit means 78 to passage 72, bore 66, cross-hole 70 and annular groove 68. In this normal working mode control means 47 seals communication of fluid to sump 74 through conduit 76. This closed fluid communication provides a fluid pressure increase in bore 66 while maintaining fluid flow for lubrication to compression chamber 32. Actuation of control means 47 by a measured parameter, such as passenger-compartment temperature, evaporation pressure or engine speed, opens communication through control fluid passage 58 to allow a fluid pressure decrease in bore 66.

A fluid pressure increase in bore 66 is communicated through cross-hole 70 and annular groove 68 to the plurality of piston bores 84. This control fluid under pressure acts on piston head 95 to move piston 90 against bias spring 98, and thus to move balls 102 from engagement with slidable vanes 42. As rotor 38 rotates through a revolution each of the vanes are moved into the extended or working position. In this working position piston 90 contacts plug 94 when control means 47 is closed. When control means 47 is actuated to the open position fluid flow is again communicated to the sump 74, control fluid pressure in bore 66 is relieved and bias springs 98 move pistons 90 and balls 102 to contact vanes 42 and detents 43. Vanes 42 are retracted and maintained in guide slits 82 in the nonworking position. Thus apparatus 20 is operable between a working or nonworking mode without use of a clutch means while only utilizing fluid control from a lubricating pump 46.

Figure 5:
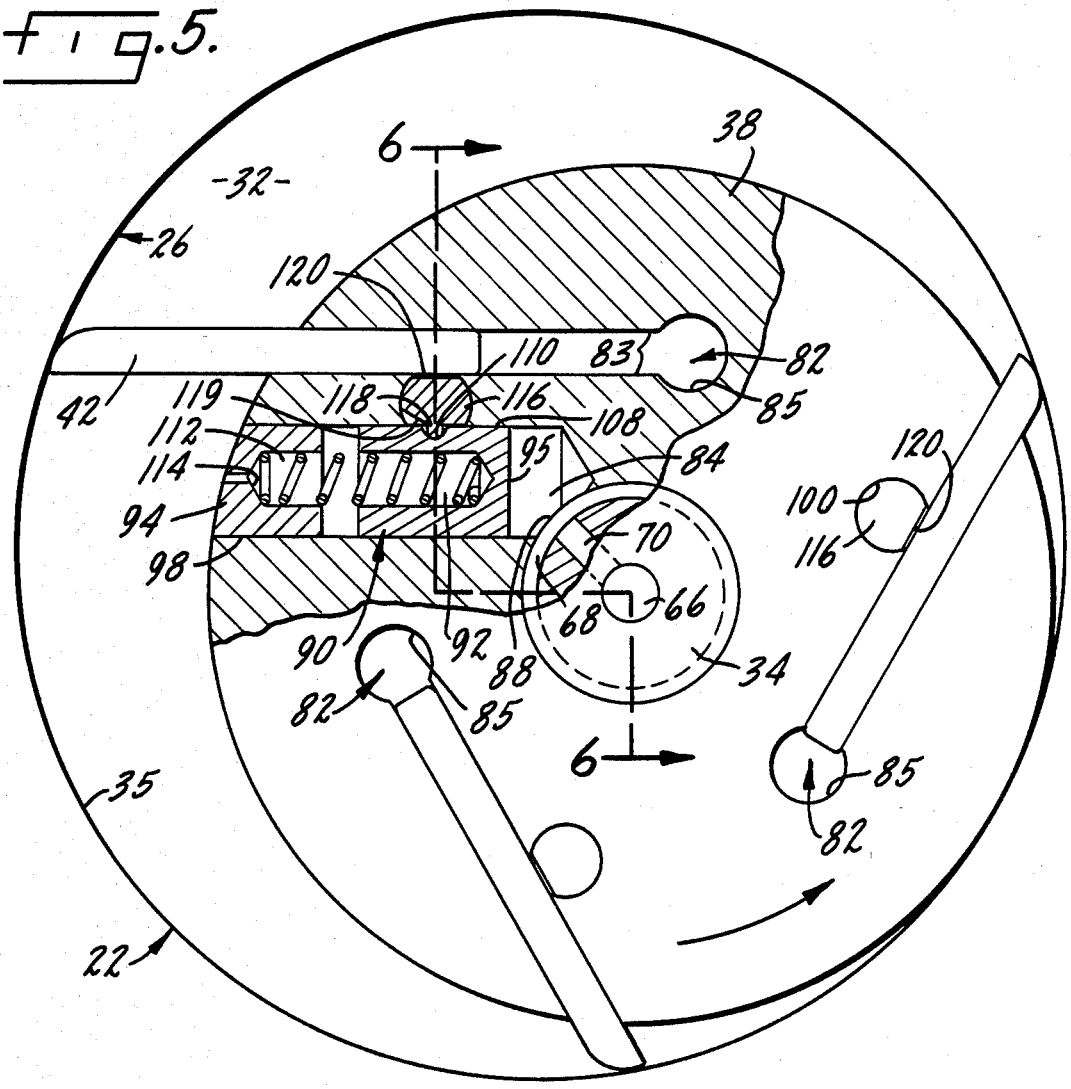
FIG. 5 illustrates an end view with portions in section of an alternative embodiment of a vane retaining means in a rotary vane apparatus.
Figure 6:
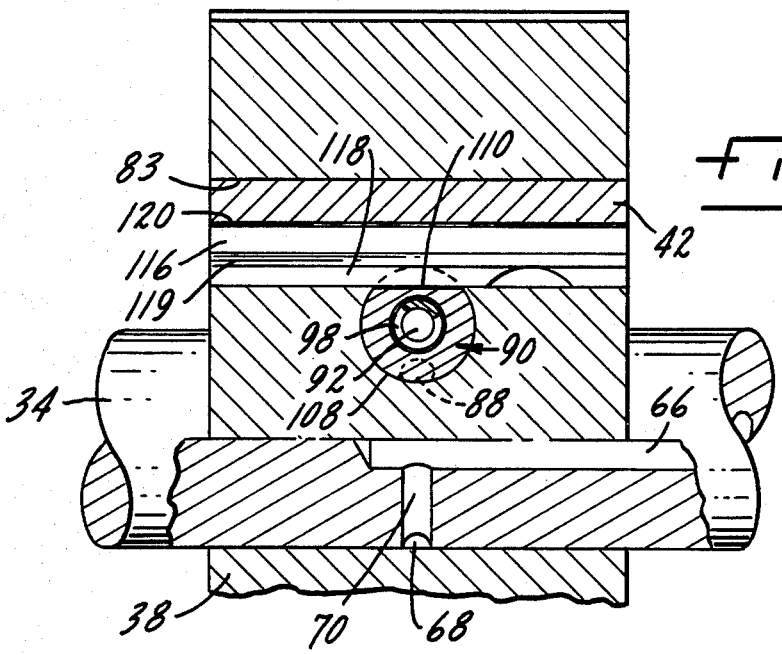
FIG. 6 is a view in cross-section along line 6—6 of the vane retaining means of FIG. 5.

In an alternative embodiment illustrated in FIGS. 5 and 6 piston 90 defines outer wall 108 and a slot 110 therein, and plug 94 defines a recess 112 with base 114 coaxial with bias spring bore 92, where bia spring 98 is constrained to act between piston 90 and base 114. In this embodiment slot 100, defined by rotor 38, is generally cylindrical. A cam-like member 16 with a chamfer 119 is positioned in ball or cam passage 100 with arcuate sidewalls 117 and is pivotable therein. Member 116 defines a tooth 118 which seats in slot 110 of piston 90, and further defines a flat 120 which, as shown in FIG. 5 is flush with guide slit sidewall 83 when piston 90 and vanes 42 are in the working position.

In this working position illustrated in FIG. 5 vanes 42 are extended from guide slits 82 to contact wall 26. In this working mode hydraulic control fluid is communicated to bore 84 through bore 66, passage 70, groove 68 and passage or opening 88 to act on piston 90 to move it against bias spring 98 toward plug 94. Such piston 90 movement rotates or pivots cam member 116 and aligns flat 120 with sidewall 83. When hydraulic control fluid pressure is removed from bore 84 bias spring 98 moves piston 90 to the nonworking or retracted position rotating cam 116 to contact vane 42 and retain it in guide slit 82 against sidewall 83. Fluid pressure is again maintained by closing control means 47 in response to a measured operating parameter to thus prohibit fluid flow to sump 74. Such closing of the control means causes control fluid pressure development in bore 84 and moves piston 90 thus rotating cam 116 into the working position.

A further embodiment of the pressure-actuable control means is illustrated in FIGS. 7, 8 and 9. Rotor 38 again defines a plurality of guide slits 82 with sidewalls 83 wherein vanes 42 reciprocate. Drive shaft 34 defines first annular snap ring groove 150 in compressor chamber 32 with a snap ring 151 wherein in proximity to first end 28 and a second annular snap ring groove 152 in proximity to second end 30 with snap ring 153 therein. Positioned about shaft 34 between rotor 38 and snap ring 151 is a stop ring 154. Similarly a stop ring 156 is positioned about shaft 34 between snap ring 153 and rotor 38. Rotor 38 defines an annular recess 159 and 161 in each of said rotor faces 39 and 41 respectively. Rotor 38 defines a first annular undercut 158 about shaft 34 at first end 28 and a second annular undercut 160 about shaft 34 at second end 30. Rotor 38 further defines a radial slot 162 for each vane at each end of rotor 38.

Vanes 42 define undercut slots 164 in FIG. 8 at each longitudinal end of guide slits 82 and each vane edge closest to said shaft 34. Positioned about shaft 34 in undercuts 158 and 160 are flexible seals 166 and 168, and spacer washers 167 and 169 respectively. Seals 166 and 168 cooperate with rotor 38 to define cavities 170 and 172 respectively. Shaft 34 defines cross-drilled passages 70 and 71 communicating between shaft blind-hole bore 66 and cavities 170 and 172, respectively.

Positioned about shaft 34 are spring latch means 174 and 176 with central cores 175 and bores 177 at faces 39 and 41, respectively. Spring latches 174 and 176 define a plurality of arms 178, one for each vane and a bent tang 180 at the extremity of each arm 178 to engage undercut slots 164 of vanes 42. A bias spring 182 is positioned about shaft 34 and between spring latches 174, 176 and snap rings 151, 153 respectively. Bias springs 182 move spring latches 174, 176 to engage undercut slots 164 of vanes 42 with bent tangs 180 to retain the vanes in the retracted position when hydraulic control fluid pressure is absent in bore 66 of shaft 34. To actuate or place the apparatus 20 in the working or compressive mode, control fluid, as from a control means illustrated in FIG. 2, is introduced in blind-hole bore 66 and is communicated to cavities 170, 172 to flex elastomeric seals 166, 168 and spacer washers 167, 169 against spring latches 174, 176 and the bias force of springs 182 to move these latches to contact stops 154, 156 and disengage tangs 180 from vanes 42. Vanes 42 are then free to extend in guide slits 82 to contact wall 26. The nonworking or vane retracted mode is actuated by removal of control fluid pressure from cavities 170 and 172, whereupon bias springs 182 move latch spring 174, 176 to engage and maintain vanes 42 in the retracted position in guide slits 82.

Figure 10:
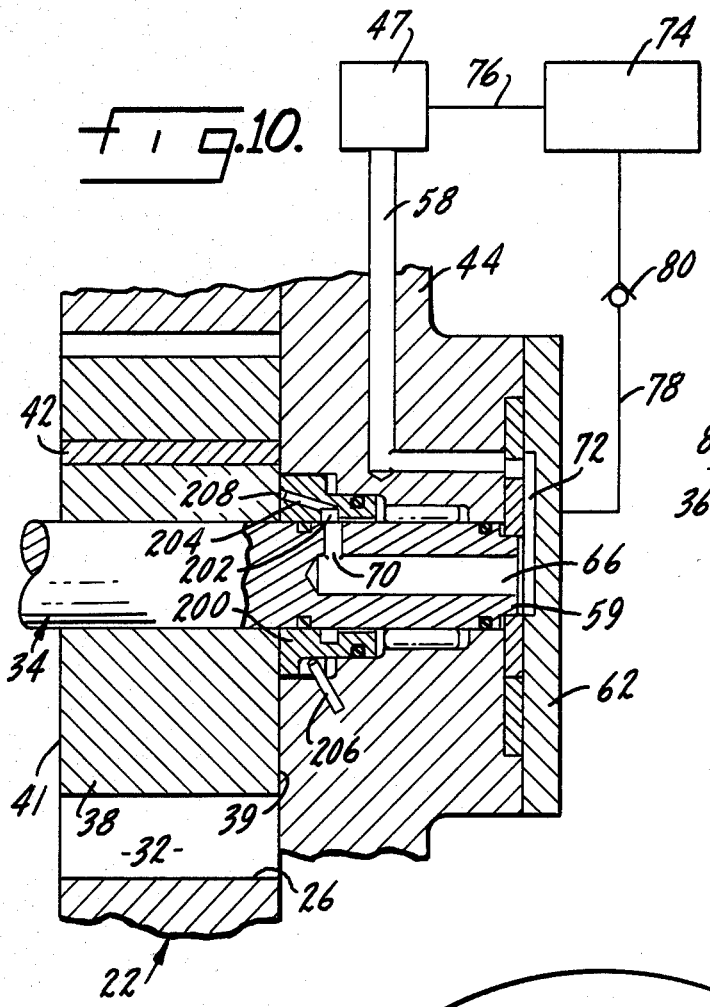
FIG. 10 is a cross-sectional view of a rotary vane assembly illustrating an hydraulic control fluid supply means to an endplate with an arcuate recess.
Figure 12:
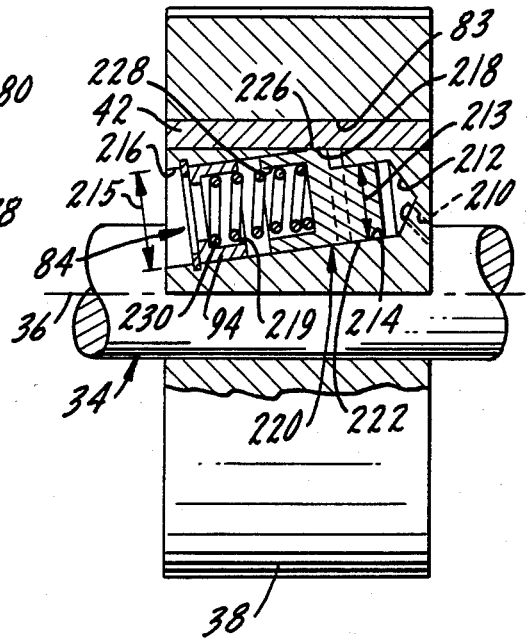
FIG. 12 is a cross-sectional view along line 12—12 of the retaining means of FIG. 11.
Figure 11:
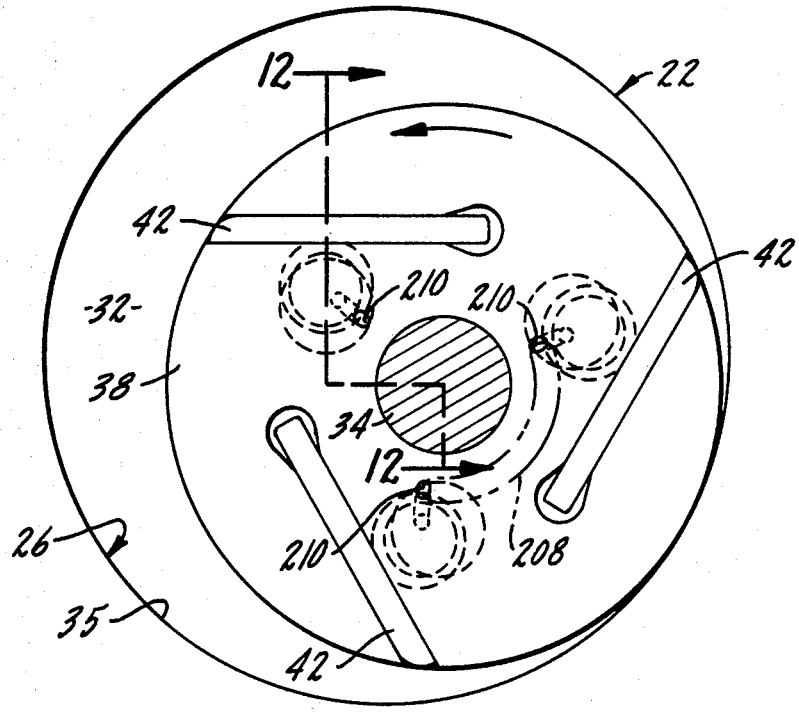
FIG. 11 is an end view of an alternative embodiment of a vane retaining means in a rotor assembly utilizing the arcuate recess of FIG. 10.

Another alternative embodiment is shown in FIGS. 10, 11 and 12 where housing 22 has a face seal 200 mounted therein to abut rotor 38. Seal 200, as the means for selectively communicating hydraulic control fluid, defines an annular groove 202 as such fluid transfer means, and an oblique passage 204, communicating between groove 202 and an arcuate slot 208 defined by face seal 200. Seal 200 further defines a longitudinal bore 201 with sidewall 203, and is mounted on shaft 34 against rotor 38. Seal 200 defines face 205 which abuts rotor 38 and is secured against rotation by a securing means 206. Rotor 38 in this embodiment defines a plurality of lateral passages 210 communicating between guide slits 82 and arcuate slot 208 when rotor 38 rotates to bring each passage 210 in register with slot 208. The slot 208 and passages 210 are only in register when slidable vanes 42 are in their retracted or nonworking positions.

In this embodiment rotor 38 defines for each vane 42 a piston bore 84 with base 212 and a longitudinal axis 211 at an inclined angle from longitudinal axis 36. Bore 84 defines a first or pilot diameter 213 with sidewall 214, and a second or body diameter 215 with sidewall 216. Rotor 38 defines an aperture 218 in sidewall 216 which opening communicates between bore 84 and guide slit 82. A plug 94 again seals bore 84 and defines a recess 219. A piston 220 is positioned in bore 84 and defines a cylindrical pilot diameter 222 matable with bore pilot diameter 213 and sidewall 214. Piston 220 defines a second body diameter 224 having a ramp-like surface 226 which will fit into opening 218 in the vane 42 nonworking position. Piston 220 further defines a recessed cavity 228 to receive a bias spring 230 positioned in recesses 219 and 228 and operable to bias piston 220 to position ramp 226 in opening 218 to contact vane 42 and retain vane 42 in the retracted position by retaining the vane 42 against guide slit sidewall 83. In this embodiment closure of control means 47 again provides a means to develop control fluid pressure in bore 66 which pressure is communicated to arcuate slot 208 through cross hole 70 and passage 204. As each guide slit 82 rotates past its point of closest contact with housing 22 vane 42 is in its retracted or nonworking position. Simultaneously passage 210 is in register with arcuate slot 208 to communicate fluid pressure to passage 210 to bore 84 to move piston 220 against bias spring 230 to thus move piston ramp 226 out of opening 218 and out of contact with vane 42. Each vane 42 is subsequently released as it passes this minimal or tangential point between the housing 12 and rotor 28. This fluid pressure is retained in each passage 210 and bore 84 until control means 47 is again open to relieve the fluid pressure in passage 210. The pressure is relieved in each passage 210 as it comes into register with arcuate slot 208 to thus allow spring 230 to expand and move piston 220 to engage vane 42 and restrain it against wall 83 of guide slit 82.

In another alternative embodiment shown in FIGS. 13 and 14, piston 220 in bore 84 defines a longitudinal slot 250 to receive a longitudinal cylindrical roller 252. Bore 84, plug 94 and piston 220 cooperate to define a chamber 254. Rotor 38 defines a ramp 256, preferably at a seven degree (7°) incline to the longitudinal axis of bore 84, on which roller 252 is movable. Rotor 38 further defines a lateral passage 258 communicating between passage 210 and chamber 254. Further, aperture 218 is shown as a longitudinal opening 217.

In operation roller 252 moves up ramp 256 in response to radial or centrifugal forces to move into opening or slot 218 to contact vane 42 and retain it against sidewall 83 when no control fluid pressure is applied to piston 220 in chamber 254. When control means 47 is closed fluid pressure is communicated through arcuate groove 208, passages 210 and 258 to chamber 254 to move piston 220 radially inward in bore 84 and to thus move roller 252 back against inclined surface 257 out of engagement with vane 42. Vane 42 is then able to extend itself to contact wall 26 in the working mode.

In an alternative embodiment illustrated in FIGS. 15 and 16 rotor 38 defines a bore 84 open to communicate with guide slit 82 and sealed by a plug 94. Vanes 42 define a through-bore 270 and a vane surface 271 to receive a hardened insert 272 defining an aperture 274, where insert 272 is flush with surface 271. Positioned in aperture 274 is a hardened ball 276. Rotor 38 defines a cavity 278 at the most radially inward length of guide slit 82. Aperture 274 is in registry with bore 84 at the most retracted position of vane 42 in guide slit 42 and bore 84 is of the same diameter as aperture 274. Thus ball 276 may be retained in bore 84, however, plug 94 is so extended as to limit the bore length of bore 84 to be less than one radius of ball 276. Cavity 278 communicates with arcuate groove 208 when vane 42 is fully retracted in guide slit 82.

When no control fluid pressure is communicated to arcuate groove 208 vane 42 retracts until bore 274 is in registry with bore 84 and ball 276 in response to radial centrifugal forces moves into bore 84 to contact plug 94. Ball 276 will thereby retain vane 42 in the retracted position with no further external force acting to move vane 42. When control fluid at an elevated pressure is introduced to arcuate groove 208 by virtue of control means 47 closing a hydraulic force acts on the outside of ball 276 and forces the ball 276 radially inward from its nested position in bore 84 and into aperture 274. Vane 42 extends itself to contact wall 26 in the working mode.

Those skilled in the art will recognize that certain variations can be made in the illustrated embodiments. While only specific embodiments of the invention have been described and shown, it is apparent that various alterations and modifications can be made therein. It is, therefore, the intention in the appended claims to cover all such modifications and alternations as may fall within the true scope and spirit of the invention.

I claim:

1. A capacity control arrangement for a rotary vane fluid displacement apparatus which apparatus includes a housing having a reference axis, at least one endplate affixed to said housing to define therewith a compression chamber having an internal wall, a source of hydraulic control fluid at a pressure, a shaft extending through said housing and having an axis parallel to the reference axis, said shaft defining an outer wall and a blind-hole bore communicating with said source of fluid at a pressure, said shaft further defining a crossdrilled passage communicating between said blind-hole bore and said outer wall, a rotor mounted on said shaft in said compression chamber, said rotor defining a front face, a rear face and a plurality of longitudinal guide slits, each slit having side walls and a root in proximity to said shaft, a plurality of slidable vanes respectively disposed in said guide slits, each vane being operable between an extended working position and a retracted nonworking position, an inlet port and a discharge valve connected to provide ingress to and egress from said compression chamber for a compressible fluid, a control means, and means for selectively communicating a hydraulic control fluid through said blind-hole bore in response to said control means, a retaining means positioned in said rotor for each of said vanes to normally engage and maintain said vanes in said retracted non-working position;

wherein said fluid displacement apparatus includes said shaft defining a fluid communication passage open to fluid communication from said source of fluid at a pressure through said cross-drilled passage and said rotor defines a plurality of lateral passages, each lateral passage communicating between said fluid communication passage and one of said retaining means to communicate fluid above a predetermined pressure to disengage said retaining means from said vanes.

2. A capacity control arrangement as claimed in claim 1 wherein said retaining means includes said rotor defining a blind-hole piston bore sealed by a plug means for each of said guide slits;

a piston for each of said piston bores which piston is slidably operable therein between a working and nonworking position;

a bias spring for each of said piston bores positioned between said piston and said plug means and operable to slide said piston to the non-working position in the absence of an external force acting against said piston;

each of said pistons defining a ramp;

said rotor defining a ball passage for each of said piston bores communicating between said piston bore and its associated guide slit and said rotor further defining a lateral passage for each of said piston bores communicating between said piston bore and fluid communication passage;

a ball in each of said piston bores slidable along said piston ramp into said ball passage to engage said vanes in the retracted, non-working position, which vane is disengageable from said ball contact when hydraulic control fluid above a predetermined pressure, in response to said control means, is communicated to said piston bore through said fluid communication and lateral passages to move said piston against said bias spring and move said ball along said ramp allowing said vane to move to said vane extended working position.

3. A capacity control arrangement as claimed in claim 1 wherein said retaining means includes said rotor defining a blind-hole piston bore sealed by a plug means for each of said guide slits;

a piston in each of said piston bores which piston is slidably operable therein between a working and nonworking position;

a bias spring for each of said piston bores positioned between said piston and said plug means and operable to slide said piston to said nonworking position in the absence of an external force acting on said pistons;

each of said pistons defines an outer wall and a slot therein;

said rotor defines a cam passage with arcuate sidewalls for each of said piston bores which cam passage communicates between said piston bores and said guide slits;

said rotor further defines for each of said piston bores a lateral passage communicating between said fluid communication passage and said piston bore;

a cam-like member positioned and pivotable in each of said cam passages;

each of said cam-like members defines a gear tooth matable with said associated piston slot and each of said cam-like members further defines a flat which is coplanar with said guide slit sidewall in the working position;

each of said cam-like members being pivotable in said cam passage by said piston to be in the working position when control fluid above a predetermined pressure is communicated to each of said piston bores through said fluid communication and lateral passages in response to said control means to allow said vanes to move to said extended working position.

4. A capacity control arrangement as claimed in claim 1 wherein said retaining means comprises:

said rotor mounted on said drive shaft being cylindrical in shape and defining a front face and a rear face;

said rotor defining an annular recess in at least one of said faces;

said rotor defining an annular undercut in proximity to said shaft and a radial slot at said root of each guide slit at which radial slot said slidable vanes protrude in the retracted or nonworking position;

a flexible seal positioned about said shaft in said annular undercut cooperates with said shaft and rotor to define a cavity which cavity communicates with said fluid communication passage and said cross-drilled passage;

a spring latch means defining a central core is positioned in said rotor face annular recess and further defines arms extending from said central core to each of said slidable vanes in said radial slots, said arms including bent tangs, said latch means further defining a centrally located bore through which said drive shaft extends;

said shaft defining an annular groove in which groove a snap ring is mounted;

a stop ring mounted between said rotor and said snap ring on said shaft, and abutting said snap ring;

a bias spring positioned about said drive shaft between the abutment of said snap ring and stop ring and said spring-latch central core to bias said spring latch means to contact said rotor;

said slidable vanes defining undercut slots at their proximity to said guide slit root which undercut slots receive said tangs to thereby retain said vanes in their retracted nonworking position;

said flexible seal being expandible to axially move said latch means along said shaft to disengage said tangs and undercut slots in response to the communication of hydraulic control fluid through said cross-drilled passage and fluid communication passage to said undercut cavity in response to said control means to allow said vanes to move to the extended working position.

5. A capacity control arrangement for a rotary vane fluid displacement apparatus which apparatus includes a housing having a reference axis, at least one endplate affixed to said housing to define therewith a compression chamber having an internal wall, a source of fluid at a pressure, a shaft extending through said housing, said shaft having an outer wall and an axis parallel to the reference axis, said shaft defining a blind-hole bore therein and a cross-drilled passage communicating between said blind-hole bore and said shaft outer wall, a rotor mounted on said shaft in said compression chamber, said rotor defining a front face, a rear face and a plurality of longitudinal guide slits, each slit having sidewalls with a root in proximity to said shaft, a plurality of slidable vanes, one of said vanes being disposed in each of said guide slits, each vane being operable between an extended working position and a retracted nonworking position, an inlet port and a discharge valve to provide ingress to and egress from said compression chamber for a compressible fluid, a control means, and means for selectively communicating a hydraulic control fluid at a pressure from said fluid pressure source through said blind-hole bore in response to said control means, a retaining means positioned in said rotor for each of said vanes to normally engage and maintain said vanes in said retracted nonworking position;

said rotor defining a plurality of lateral passages, each lateral passage communicating between said rotor front face and one of said retaining means said retaining means being disengaged from maintaining said vanes in said retracted nonworking position by hydraulic control fluid above a predetermined pressure communicated through said lateral passage to allow said vanes to move to the extended working position;

a face seal, defining a longitudinal bore with a side wall, is mounted and retained in said endplate in a fixed position, said face seal defining a face abutting the rotor and an arcuate recess in said face, said face seal further defining a fluid communicating passage in said bore side wall in register with said shaft cross-drilled passage, which fluid communicating passage provides communication between said cross-drilled passage and said arcuate recess, which arcuate recess communicates with each of said rotor lateral passages as said rotor rotates about the axis of said shaft to thereby provide hydraulic control fluid communication above a predetermined pressure to disengage said retaining means only when said rotor lateral passage to each retaining means is in register with said arcuate recess.

6. A capacity control arrangement as claimed in claim 5, wherein said retaining means comprises said rotor defining a blind-hole piston bore for each vane with a longitudinal axis inclined at an acute angle to the longitudinal axis of said rotor, said piston bore is sealed by a plug means;

said blind-hole piston bore including a pilot diameter segment and a second diameter segment larger than said first diameter segment;

said rotor further defining a front face and a rear face and a lateral passage for each piston bore communicating between one of said faces and said blind-hole piston bore, said rotor also defining an aperture communicating between said piston bore second diameter and said guide slit;

a piston positioned in said piston bore and defining a pilot diameter matable with said piston bore pilot diameter and a second diameter matable with said second diameter of said piston bore, said piston further defining a ramp-like surface that is matable with said aperture between said guide slit and piston bore when said piston is in the nonworking or vaneretracted mode, a bias spring, which is positioned in said piston bore between said plug means and said piston, to move said piston to engage said vane with said piston ramp-like surface in the absence of a hydraulic force acting on said piston;

said vanes being disengageable from said piston ramp-like surface contact by communication of hydraulic control fluid above a predetermined pressure to said piston bore in response to said control means, which control fluid acts on said pilot diameter of said piston to move said piston against the bias force of said spring and thereby disengage said vanes for movement to said vane extended working position.

7. A capacity control arrangement as claimed in claim 6 wherein said acute angle of said blind-hole piston bore is inclined at about seven degrees from said longitudinal axis of said rotor.

8. A capacity control arrangement as claimed in claim 5 wherein said retaining means comprises said rotor defining a blind-hole piston bore with a sidewall for each vane and guide slit, and which bore is sealed by a plug means;

said rotor defining a longitudinal slot communicating between said piston bore and guide slit;

a slidable piston positioned in each of said bores operable between a nonworking and working position and responsive to radial force in the absence of an intervening force, and said piston, plug means and piston bore sidewall cooperate to define a variable volume chamber in each piston bore;

said piston defines a longitudinal slot with a longitudinal cylindrical roller positioned in each of said longitudinal slots;

said rotor further defining a lateral passage for each piston bore communicating between said rotor face and said variable volume chamber, which passage at said face is in register with said face seal arcuate slot when said vanes are in their retracted position;

said piston being movable to move said roller into said nonworking position along said ramp-like surface and into said longitudinal slot to engage and retain said vane therein in response to radial forces;

said vanes being disengageable from said retracted position by the communication of hydraulic control fluid above a predetermined pressure to said variable volume chamber to move said piston and thus to disengage said roller and vane in each guide slit to allow said vane to move to the extended working position.

9. A capacity control arrangement as claimed in claim 8 wherein said piston bore of said retaining means is parallel to the plane of each of said guide slits with which it cooperates.

10. A capacity control arrangement for a rotary vane fluid displacement apparatus which apparatus includes a housing having a reference axis, at least one endplate affixed to said housing to define therewith a compression chamber having an internal wall, a source of fluid at a pressure, a shaft extending through said housing, said shaft having an outer wall and an axis parallel to the reference axis, said shaft defining a blind-hole bore therein and a cross-drilled passage communicating between said blind-hole bore and said shaft outer wall, a rotor mounted on said shaft in said compression chamber, said rotor defining a front face, a rear face and a plurality of longitudinal guide slits, each slit having sidewalls with a root in proximity to said shaft, a plurality of slidable vanes, one of said vanes being disposed in each of said guide slits, each vane being operable between an extended working position and a retracted nonworking position, an inlet port and a discharge valve to provide ingress to and egress from said compression chamber for a compressible fluid, a control means, and means for selectively communicating a hydraulic control fluid at a pressure from said fluid pressure source through said blind-hole bore in response to said control means, a retaining means positioned in said rotor for each of said vanes to normally engage and maintain said vanes in said retracted nonworking position;

said retaining means being disengaged from maintaining said vanes in said retracted nonworking position by hydraulic control fluid above a predetermined pressure communicated to said guide slit root to allow said vanes to move to the extended working position;

a face seal, defining a longitudinal bore with a side wall, is mounted and retained in said endplate in a fixed position, said face seal defining a face abutting the rotor and an arcuate recess in said face, said face seal further defining a fluid communicating passage in said bore side wall in register with said shaft cross-drilled passage, which fluid communicating passage provides communication between said cross-drilled passage and said arcuate recess, which arcuate recess communicates with each root of said guide slits as said rotor rotates about the axis of said shaft to thereby provide hydraulic control fluid communication above a predetermined pressure to disengage said retaining means from said vanes only when said guide slit root is in register with said arcuate recess.

11. A capacity control arrangement as claimed in claim 10 wherein said retaining means comprises said rotor defining a bore for each guide slit communicating between said guide slit and said compression chamber, which bore is sealed by a plug means which extends into said bore;

said plug means and rotor cooperating to define a bore open to communicate with said guide slit;

said vanes each define a through-bore and a vane surface;

an insert is fitted into each through-bore to be coincidental with said vane surfaces and each insert defines an aperture of the same diameter as said bores defined by said rotor;

said roots of said guide slits being in register with said face seal arcuate recess at said rotor face when said vanes are in their retracted position;

a hardened ball positioned in said insert aperture which ball is matable with said bore open to communicate with said guide slit to rest against said bore plug means to retain said vane in the retracted position, said vane being disengaged from said retracted position by the communication of hydraulic control fluid to said balls to force said balls into said insert aperture and permit said vanes to extend to their working position.

12. A capacity control arrangement as claimed in claim 11 wherein said plug means extends into said rotor bore a distance of less than one radius of said hardened ball below said sidewall of said guide slit.

* * * * *

UNITED STATES PATENT AND TRADEMARK OFFICE

CERTIFICATE OF CORRECTION

PATENT NO. : 4,516,919

DATED : May 14, 1985

INVENTOR(S) : RICHARD W. ROBERTS

It is certified that error appears in the above—identified patent and that said Letters Patent is hereby corrected as shown below:

Column 11, line 66, cancel"vaneretracted" and insert -- vane-retracted --.

Signed and Sealed this

*Twentieth* Day of *August 1985*

[SEAL]

*Attest:*

DONALD J. QUIGG

*Attesting Officer*

*Acting Commissioner of Patents and Trademarks*